United States Patent [19]

Grohoski

[11] 4,088,045

[45] May 9, 1978

[54] PLANETARY WORK FORMING MACHINE HAVING IMPROVED STARTER TIMING CONTROL AND STARTER DRIVE SELECTOR

[75] Inventor: Edward Gregory Grohoski, Litchfield, Conn.

[73] Assignee: The Hartford Special Machinery Company, Simsbury, Conn.

[21] Appl. No.: 747,483

[22] Filed: Dec. 6, 1976

[51] Int. Cl.[2] ..... B23B 29/24; F16H 35/06; F16H 35/08

[52] U.S. Cl. ..... 74/813 C; 74/399; 74/403

[58] Field of Search ..... 74/813 C, 813 R, 398, 74/399, 402, 403

[56] References Cited

U.S. PATENT DOCUMENTS

| | | | |
|---|---|---|---|
| 3,048,059 | 8/1962 | Cross | 74/813 C |
| 3,941,014 | 3/1976 | Benjamin et al. | 74/813 C |

*Primary Examiner*—Leonard H. Gerin

*Attorney, Agent, or Firm*—Prutzman, Hayes, Kalb & Chilton

[57] ABSTRACT

A machine is disclosed which incorporates a timing control for modifying the timing of a starter for feeding work blanks to a forming station and which features a manual control for applying a supplementary rotary input into a spindle operated differential having an output drivingly connected to the starter for effecting a desired change in the timing of starter movements in relation to a circular die fixed to the spindle at the forming station. In addition, a starter drive selector is provided having a manual interlock for selectively adjusting the number of starter operations for each revolution of the spindle and its circular die.

20 Claims, 8 Drawing Figures

PLANETARY WORK FORMING MACHINE HAVING IMPROVED STARTER TIMING CONTROL AND STARTER DRIVE SELECTOR

This invention generally relates to planetary work forming machines and particularly concerns a starter timing control for establishing die match in a planetary thread rolling machine, e.g., under either static or dynamic conditions, and a starter drive control for establishing a selected number of starter operations for each revolution of a circular work forming die.

A primary object of this invention is to provide a new and improved control for timing the operation of a workpiece starter at a work forming station such that each workpiece being fed to a starting end of a fixed die, e.g., may be precisely rolled in match with the fixed and movable dies.

Another object of this invention is to provide such a timing control which may be quickly operated to adjust the starter timing under static or stationary conditions as well as under dynamic operating conditions without shutting off the machine.

A further object of this invention is to provide a starter timing control of the type described which provides for quick and easy machine set up for a production run in significantly reduced time and which provides for increased production of high quality products.

Yet another object of this invention is to provide a new and improved starter drive selector to selectively establish in a quick and easy fashion a predetermined drive setting between the input to the spindle, governing the rotational speed of the circular die, and the starter which engages the workpieces in succession and inserts them between the dies.

A yet further object of this invention is to provide such a starter drive selector which is quickly and easily operated manually for selecting either a three or four lobe starter cam, e.g., which is drivingly connected to a starter drive mechanism for establishing a predetermined number of workpiece starts in timed relation to each revolution of the circular die.

Another object of this invention is to provide a new and improved planetary work forming machine which incorporates the above described mechanisms which are of relatively simplified construction, are economical to manufacture for reliable operation over an extended service life and are particularly suited to ensure dependable operation of the machine while at the same time permitting flexibility in its operation and adjustment of starter actuation to different series of die starts for spreading wear on the circular die to ensure longer die life.

Other objects will be in part obvious and in part pointed out more in detail hereinafter.

A better understanding of this invention will be obtained from the following detailed description and the accompanying drawings of illustrative applications of the invention.

Figure 1:
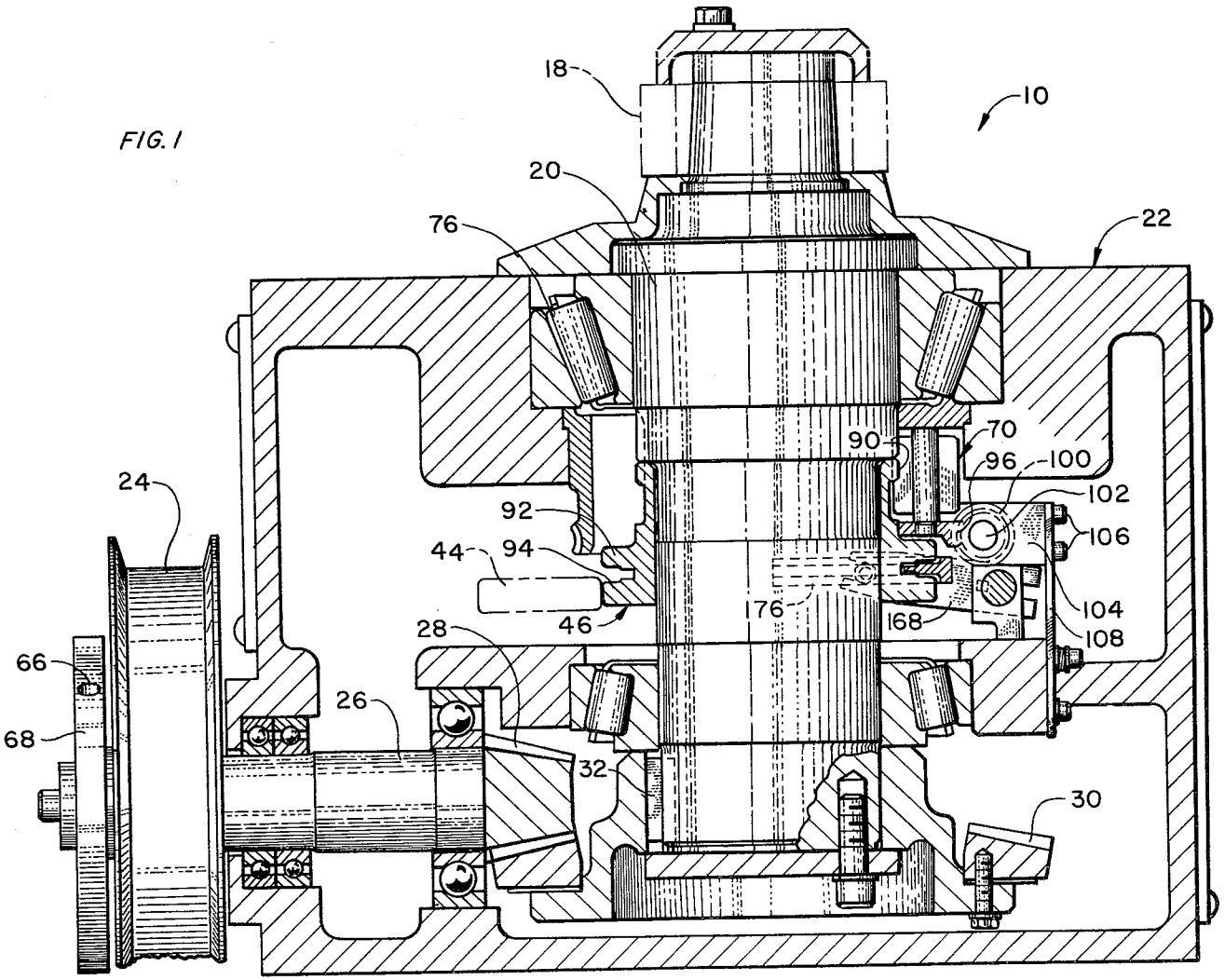
FIG. 1 is a side elevational view, partly broken away and partly in section, of a planetary work forming machine incorporating this invention.

Referring to the drawings in detail, a machine 10 incorporating this invention is illustrated in FIG. 1. FIG. 1 specifically shows a planetary thread rolling machine for high production thread rolling of workpieces or blanks. It is to be understood that this invention is not limited in its application to only thread rollers but is equally useful in other planetary work forming machines such as point forming machines and the like.

In machine 10, blanks are fed from a hopper, not shown, down a pair of inclined feed rails 12 to a starting entrance wherein a blank 14 is illustrated as being in a starting position between a fixed segmental die 16 and a movable circular die 18 supported for rotation on an upper end of a main drive spindle 20. Circular die 18 is suitably mounted for rotation continuously about a fixed axis of spindle 20 which is rotatably mounted on a fixed frame 22 of machine 10. A conventional motor drive, not shown, is belted to an input pulley 24 which drives a pinion shaft 26 rotatably supported on frame 22 and having a drive pinion 28 engaging a ring gear 30 shown fixed by key 32 to the bottom of spindle 20.

To pace operation of a work blank starter 34 (FIG. 2) and to feed each blank in the feed rails 12 successively between the dies 16, 18, a starter drive mechanism 36 is provided which serves to retract starter blade 38 in one linear direction to open the end of feed rails 12 and to remain open long enough for a single workpiece or blank 14 to be admitted from the end of the feed rails 12 into position between a starter end or entrance end of the fixed segmental die 16 and the circular die 18. Then the end blank 14 is wedged between the dies 16, 18 by the blade 38 upon its movement in the opposite linear direction such that friction between the blank 14 and the dies 16, 18 causes the blank 14 to roll in a planetary fashion about the fixed segmental die 16 to form a thread rolled onto the periphery of the blank 14.

Starter drive mechanism 36 includes a cam controlled bell crank 40 mounted on an upright pivot shaft 42 supported for rotation on frame 22. Pivot shaft 42 serves to transmit oscillating movements in response to movement imparted to bell crank arm 40A on which a starter cam follower roll 44 is supported for rotation. Cam follower roll 44 engages a starter cam 46 shown supported intermediate the spindle 20 to pivot arm 40A and the pivot shaft 42. Crank arm 48 is urged by a spring 45 in a clockwise direction as viewed in FIG. 2 to maintain the cam follower roll 44 engaged with the starter cam 46.

To establish a desired length of stroke of starter blade 38, a swinging end of arm 48, secured to an upper portion of pivot shaft 42, is shown having a slot 50 within which a pivot pin 52 is fixed in selected position in accordance with the required starter stroke length. A turn buckle 54 is suitably connected at its opposite ends to the pivot pin 52 and a second pivot pin 56 supported on a bell crank 58 mounted for pivotal movement about shaft 60 fixed to frame 22.

Figure 2:
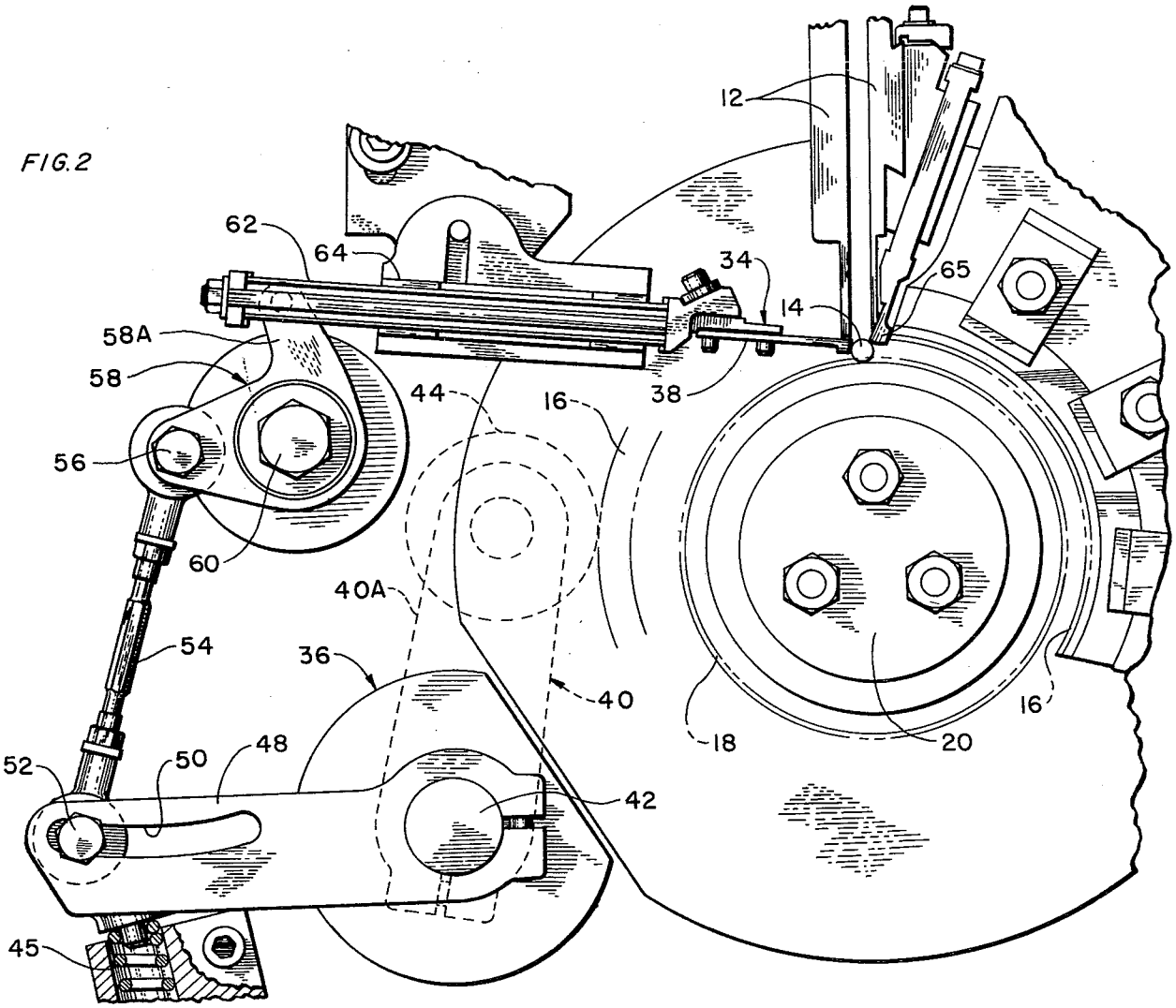
FIG. 2 is a top plan view, partly broken away, of the machine of FIG. 1.

Pivoting movement of bell crank 58 responsive to cam follower oscillation effects oscillating movements of bell crank arm 58A pinned to a starter bar slide 62 supported for sliding movement on slide base 64 fixed to frame 22 to alternately advance starter blade 38 for wedging workpiece 14 between dies 16, 18 and retract blade 38 to open feed rails 12 and permit the next workpiece to move into starting position in contact with the circular die 18, as shown in FIG. 2. The position of the workpiece 14 in its starting position when starter blade 38 is retracted is maintained by any suitable means such as the illustrated conventional pressure foot 65 which restrains the workpiece 14 against premature entry between the dies 16, 18 until positively pushed by the next advancing movement of blade 38. Starter blade reciprocation accordingly will be seen to be determined by the throw of the starter cam follower roll 44 in timed relation to rotation of the circular die 18 fixed at the top of spindle 20.

Instantaneous relative positions of starter blade 38, the two dies 16, 18 and each workpiece 14 must be such that the thread crest is always opposite a root on the workpiece being threaded. When such a relationship is accurately established, the dies 16, 18 are said to be "in match" with the workpiece. If the threads on one die do not accurately "track" those on the other die, there is an undesirable shaving action on the threads, producing tiny slivers of metal. Such a work forming process produces poor quality end products and that process is no longer pure metal deformation as intended.

The function of the described starter 34 is to push each workpiece into engagement with the dies 16, 18 at the exact instant the dies are "in match", and this must be done in a dynamic running condition when machine 10 is operating at full speed. Normally, in setting up the machine 10 for a production run, a trial workpiece is inserted between dies 16, 18 by blade 38 as circular die 18 is slowly turned over by hand by a bar, not shown, inserted in a radial opening such as at 66 in disk 68 keyed to pinion shaft 26. The workpiece is caused to rotate just short of one-half a revolution about its axis and then backed out and examined. Unless the thread impression left by one die exactly "tracks" that of the other die, it is necessary to adjust the starter timing to correct the die match.

In the known conventional machines, starter timing adjustments must be made while a machine of this type is in a stationary or so-called static condition. Moreover, any timing adjustment normally requires that the starter cam be loosened from its mounting bolts, e.g., securing it to its spindle and then moved to a different position. After the mounting bolts are retightened, the machine may be brought up to speed to determine whether the dies are "in match" to properly deform the next trial workpiece.

Under dynamic conditions, die match is frequently lost because of the inertia of moving parts, slippage of the workpiece on the dies and similar problems well known to those involved in the subject art. Workpiece shaving often results, and small slivers of metal are seen on the finished workpieces indicative of poor quality. The operator must then stop the machine, manually readjust the starter timing and again check the starter timing under dynamic conditions. Such a procedure must be repeated until the dies are "in match".

To modify starter timing quickly and easily in relation to operation of dies 16, 18 in accordance with this invention, a differential 70 is provided in the drive between spindle 20 and the starter cam 46. The differential 70 not only provides a normal drive to the starter cam 46 controlling the starter drive mechanism 36, but also provides selective timing adjustments to be made to the starter drive mechanism 36 in its relationship to the dies.

More specifically, in the embodiment of the invention shown in FIGS. 1–4, a first rotary input to the differential 70 is shown in the form of a ring spur gear 72 fixed by set screw 74 to spindle 20 below its main bearing 76. Ring spur gear 72 is in mesh with an input spider gear 78 which is in mesh with an output spider gear 80. Spider gears 78, 80 are shown supported for rotation about their rotational axes in a planet gear carrier 82. It will be understood that there may be three substantially identical sets of spider gears 78, 80 of the type described mounted for rotation within the planet gear carrier 82 in equally angularly spaced relation about the spindle 20. The planet gear carrier 82 has a radial flange 84 provided bearing support by an underlying shoulder 86 of the machine frame 22 surrounding spindle 20 such that gear carrier 82 is supported for rotation relative to spindle 20.

The differential 70 under normal operation provides a direct 1:1 drive to a differential rotary output during which operation the spindle 20 rotates and the gear carrier 82 remains stationary. The rotary output of differential 70 is shown as a sleeve 88 concentrically supported for rotation on spindle 20 with gear teeth 90 circumferentially extending about an upper end of sleeve 88 in mesh with the output spider gear 80 of each spider gear set. A pair of disk starter cams 92, 94 are shown integrally formed at the lower end of sleeve 88. Sleeve 88 is supported for rotation relative to spindle 20. Under normal conditions spindle rotation provides a 1:1 drive to the starter cam 46 to control the motion of starter drive mechanism 36 and its blade 38 in timed relation to rotation of the movable circular die 18 at the top of spindle 20.

To provide quick-change timing adjustment of starter 34 under either stationary or in-flight conditions, the planetary gear carrier 82 has worm gear teeth 96 cut in its bottom plate 98 with the worm gear teeth 96 in mesh with a manually controlled worm 100. More specifically, the worm 100 is fixed to a manually rotatable operator shaft 102 journaled within a housing 104 with the housing 104 fixed by conventional fasteners 106 to a worm carrier plate 108. Shaft 102 is of a length sufficient to extend byond the frame 22 of machine 10 and has an end hex head 10 fixed to shaft 102 by pin 112 and which can be engaged by any suitable tool for rotating the shaft 102 and its worm 100 to impart a supplementary input to differential 70. That is, manual rotation of operator shaft 102 causes worm 100 to rotate in a selected angular direction and effect angular displacement of the planetary gear carrier 82 about spindle 20. Such action results in either speeding up or slowing down rotation of the intermediate gearing 78, 80 within carrier 82 depending on the direction of rotation of worm 100. A differential drive is thereby effected upon operating the manual shaft 102 to adjust the starter timing in relation to spindle rotation by rotating the starter cam 46 connected to the starter 34 in accordance with the combined inputs of the spindle ring spur gear 72 and the worm 100.

Figure 6:
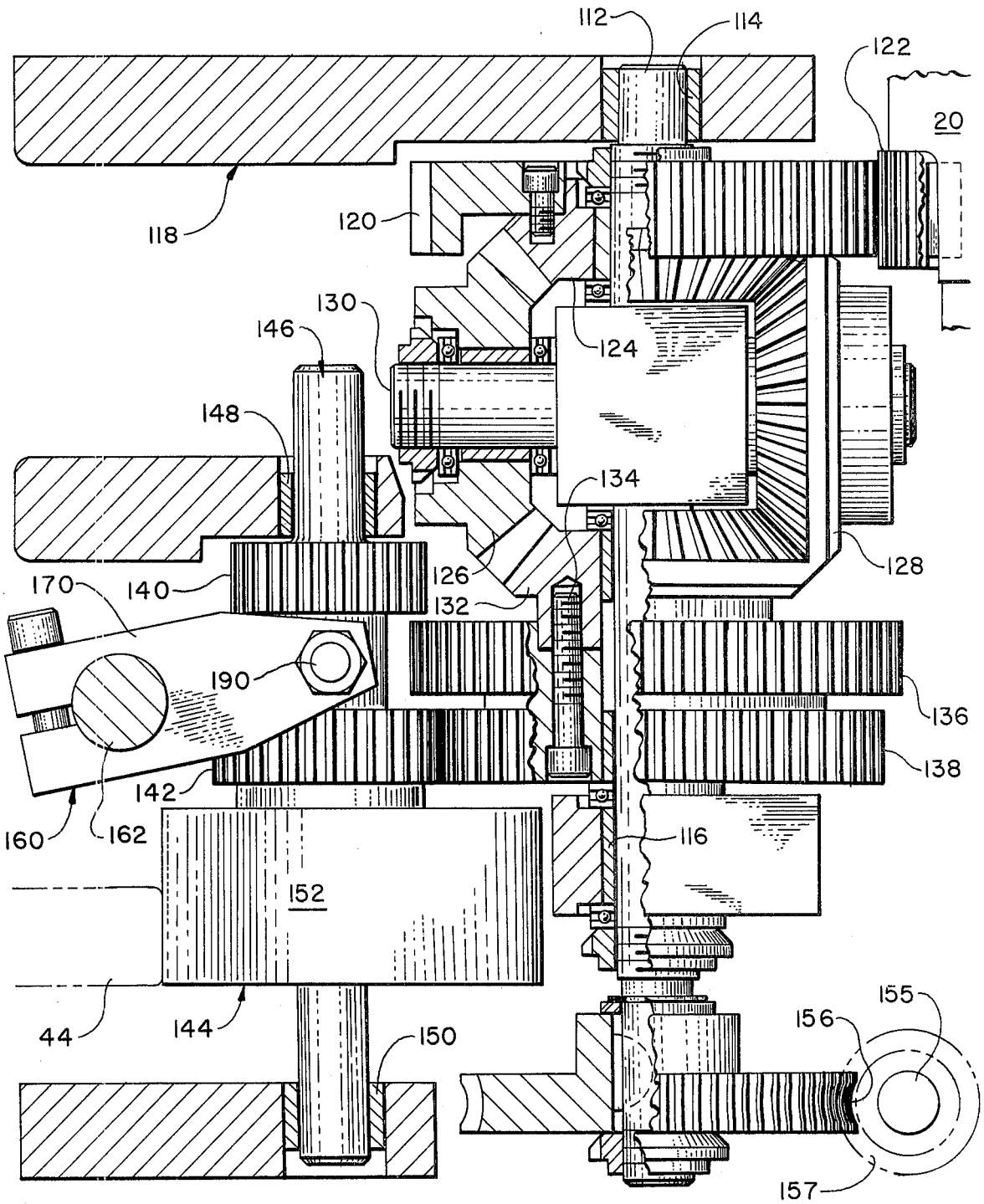
FIG. 6 is a sectional view, partly broken away, of a second embodiment of differential gearing incorporated in the machine.
Figure 7:
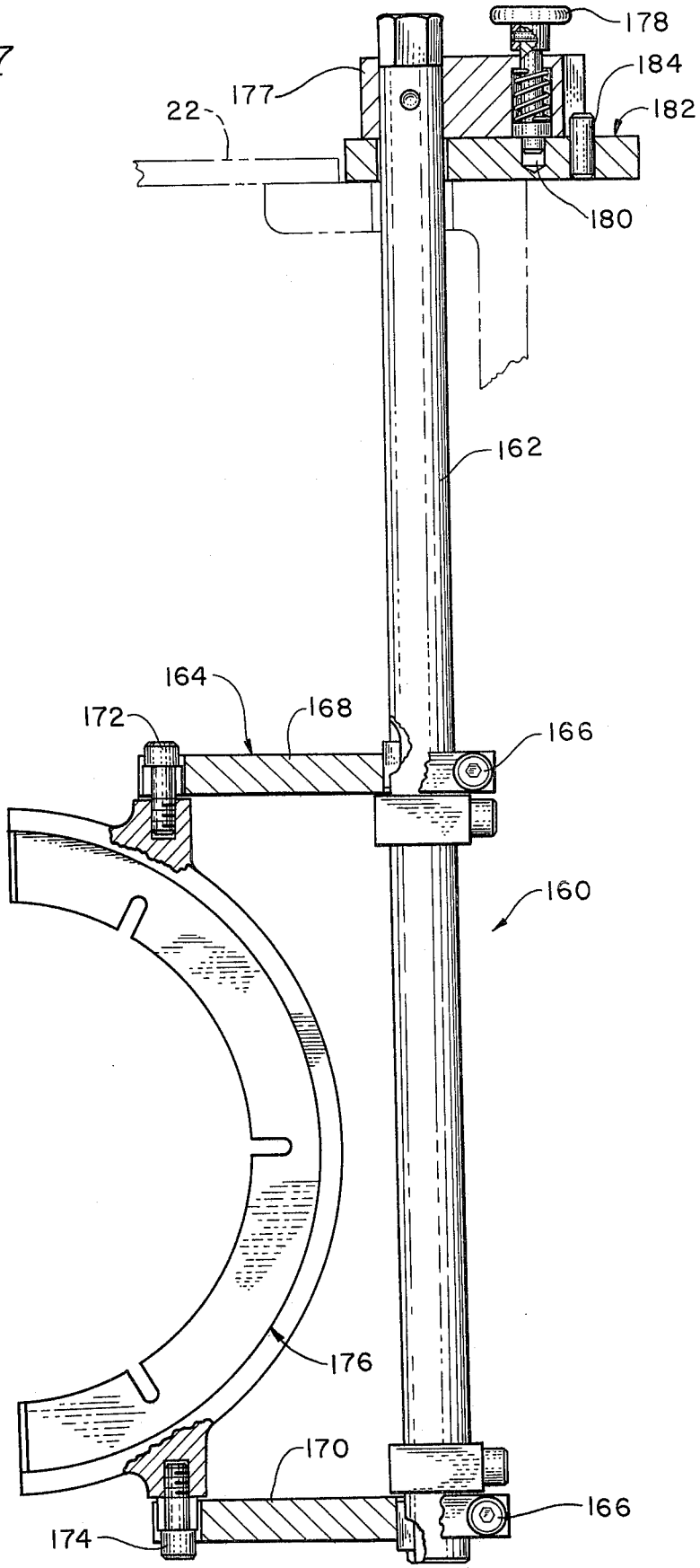
FIG. 7 is a plan view, partly broken away and partly in section, illustrating selected components of a starter drive selector incorporated in this invention.

In FIG. 6 a second embodiment of the quick-change starter timing control is illustrated. This second embodiment likewise provides means for changing the starter actuation timing when machine 10 is stationary as well as for refining the same in relation to a given rotational movement of circular die 18 to provide in-flight die matching observed when the machine 10 is in operation.

More specifically, rotatable differential mounting shaft 112 is illustrated as being journaled in bearings at 114 and 116 mounted on the fixed frame 118 of machine 10 in an upright position in spaced parallel relation to spindle 20. A take-off gear 120 is rotatably mounted on shaft 112 with the take-off gear 120 in mesh with a spindle input gear 122. A bevel gear 124 is connected to rotate with the take-off gear 120 in mesh with intermediate bevel gears 126, 128 supported for rotation on a cross shaft 130 fixed to and extending in perpendicular relation to differential mounting shaft 112. The intermediate bevel gears 126, 128 mesh with a lower bevel drive gear 132 supported for rotation on mounting shaft 112 and having a direct drive connection via connecting pins 134 to compound change gears 136, 138 rotatably supported on shaft 112. Gears 136 and 138 are respectively and alternatively engageable with drive output gears 140 and 142 of a combination gear and cam stack 144 mounted on shaft 146 which is supported in parallel spaced relation to shaft 112 for rotation and axial sliding movement within bearings 148, 150 mounted on frame 10. In the position illustrated in FIG. 6, change gear 138 engages drive output gear 142 to rotate a single lobe starter cam 152 which is in contact with the cam roll follower 44 of the starter drive mechanism 36 as previously described in connection with the first embodiment.

Differential mounting shaft 112 is stationary under normal driving conditions. Keyed at the base of shaft 112 is a worm gear 156. It is to be understood that a manual operator shaft 155 having a worm 157 secured thereto is suitably mounted as described in connection with the first embodiment to engage worm 157 with teeth of the worm gear 156. Selective manual rotation of the shaft 155 and its worm 157 angularly displaces the differential mounting shaft 112 via the teeth on worm gear 156, and the angular movement of shaft 112 correspondingly rotates cross shaft 130 to effect a timing adjustment corrective movement to the compound change gears 136, 138 to provide the desired starter timing adjustment. Once such a desired timing adjustment is established, the manual operator shaft 155 is released and normal drive conditions prevail with cam 144 operating through the differential responsive to spindle rotation and with the differential mounting shaft 112 in a stationary position.

As noted above, it is the function of the starter 34 to push the workpiece 14 into engagement with dies 16, 18 at an exact instant that the dies will be in match with the workpiece. Such a condition occurs many times during each revolution of the circular die 18, typically there are between 20 and 50 times during each revolution of die 18 when workpiece starts may be initiated. Practical considerations require that only a few workpieces be inserted for each revolution of the circular die 18, frequently only three or four workpiece starts per spindle or circular die revolution.

To provide quick and easy selection of a given series of workpiece starts per revolution, this invention additionally provides for a selectively settable cam drive connection to the starter drive mechanism 36 for driving it in a first drive setting and alternatively in a second drive setting different from that established in the first setting. While there indeed may be even more than two such drive settings for the starter mechanism 36 to effect a yet further choice of a given number of workpiece starts per spindle revolution, it will suffice for an understanding of this invention to describe it in terms of two different starter drive settings.

Figure 3:
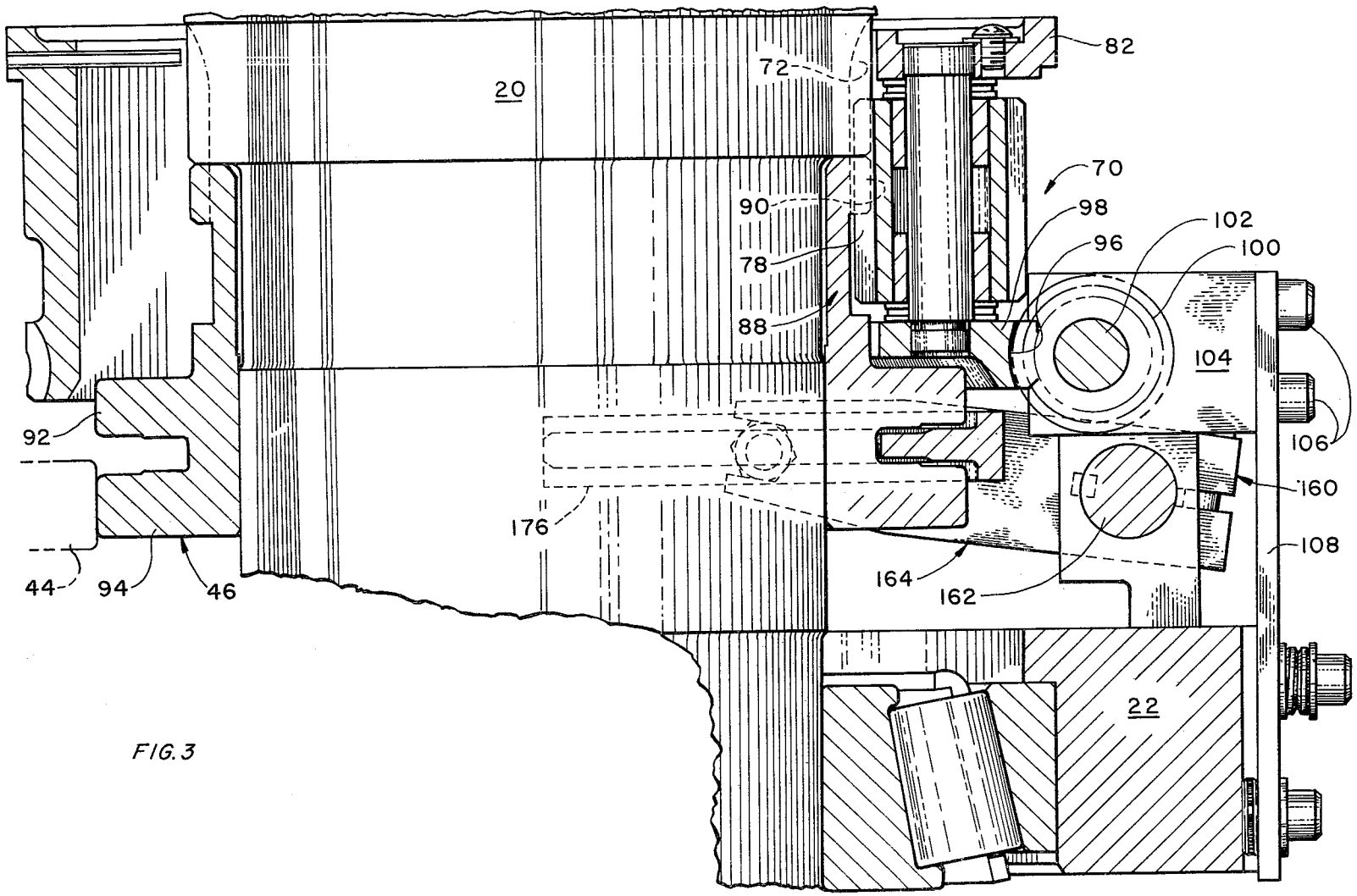
FIG. 3 is an enlarged view, partly broken away and partly in section, illustrating differential gearing incorporated in the machine of FIG. 1.
Figure 4:
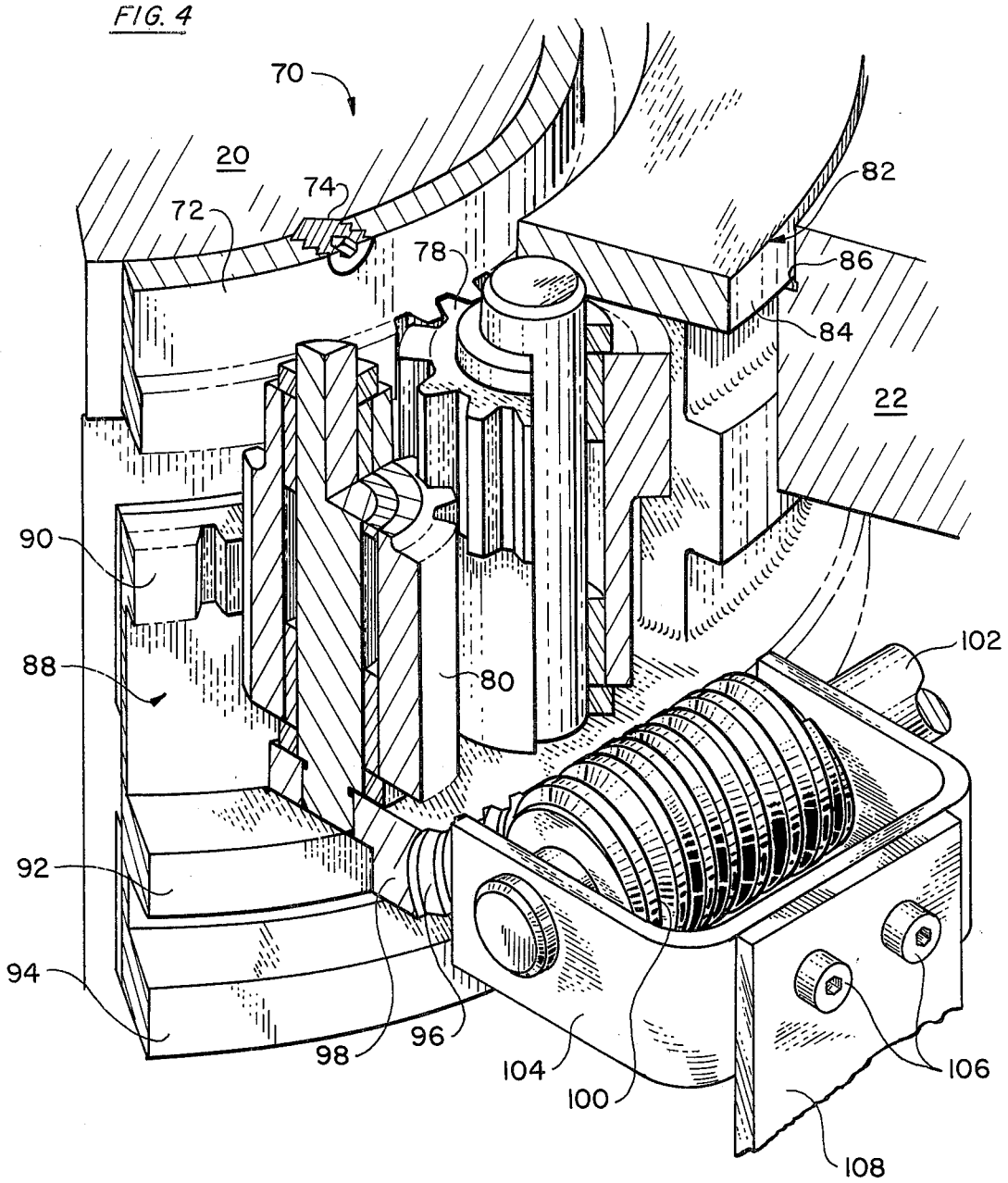
FIG. 4 is an enlarged isometric view, partly broken away, partially showing the differential gearing of FIG. 3.
Figure 5:
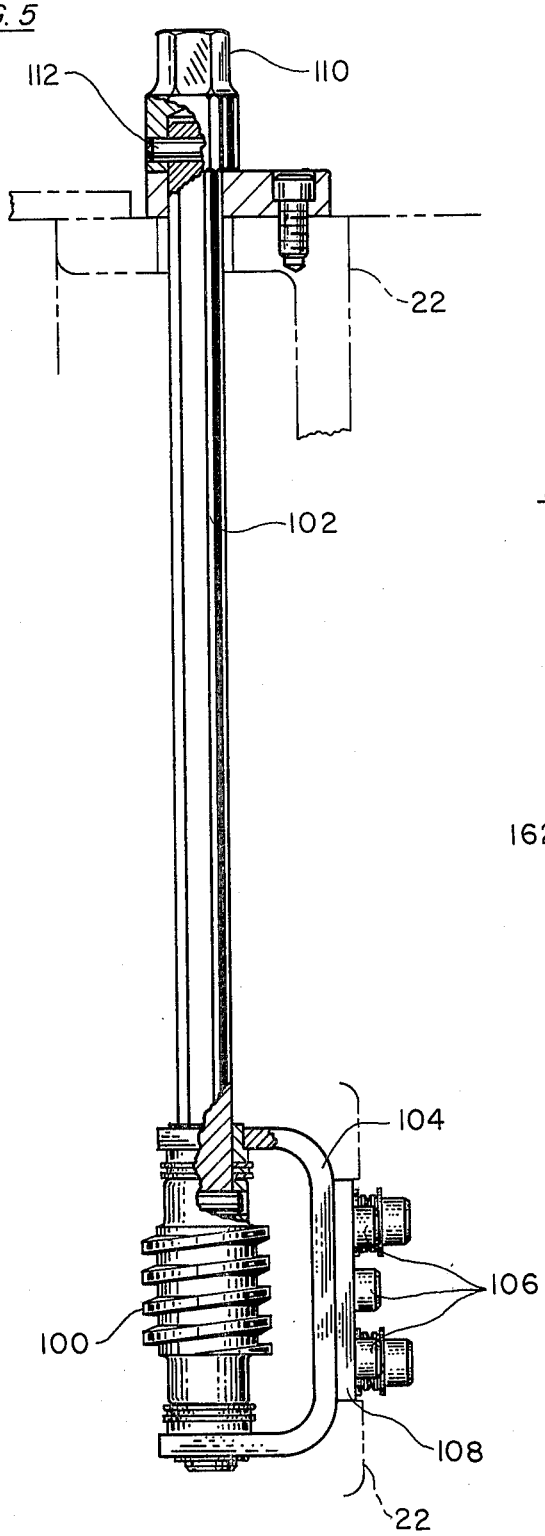
FIG. 5 is a plan view, partly in section and partly broken away, showing a manual operator shaft for the starter timing control of this invention.

In the embodiment shown in FIGS. 2 and 3, an interlock 160 is connected in accordance with this invention to the cam drive connection and is operable to selectively change the drive setting of the starter drive mechanism 36. I.e., the disk starter cam means 92, 94 is axially shiftable by the interlock 160 for selectively establishing different drive connections between spindle 20 and starter drive mechanism 36 in the first and second drive settings to impart different driving cam motions to be followed by the cam controlled starter drive mechanism 36 such that a predetermined number of starter operations are effected for each revolution of the spindle 20 and its circular die 18.

More specifically, interlock 160 includes a manual mode select shaft 162 supported for pivoting movements about its axis on frame 22 of the machine 10. A yoke 164 is shown embracing shaft 162 and secured thereon by threaded fasteners such as at 166. Yoke 164 comprises a pair of arms 168, 170 projecting radially from shaft 162 and secured by pivot pins 172, 174 to a semi-circular shifter fork 176 shown interposed between disk cams 92, 94 with the fork 176 embracing the base of the sleeve 88.

Figure 8:
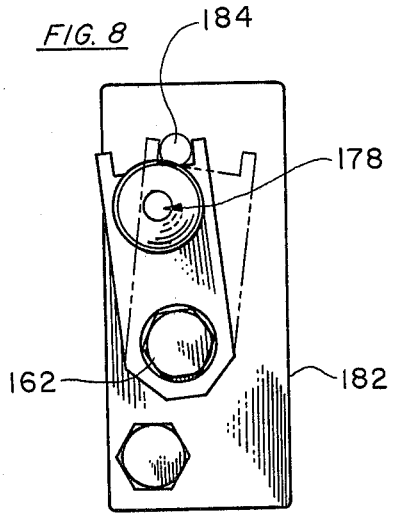
FIG. 8 is an end view of a mode select lever of the drive selector of FIG. 7.

By virtue of the described construction, sleeve 88 is axially shiftable on spindle 20 between first and second drive setting positions to selectively engage the starter cam follower roll 44 with either of the starter cams 92, 94 which have, e.g., respectively three and four lobe working profiles. In the position illustrated in FIG. 3, cam 94 which will be understood to be a three lobe cam, is shown engaging starter cam follower roll 44 to provide three workpiece starts per revolution of the spindle 20 and its circular die 18. If it is desired to change this series of starts to four workpiece starts per spindle revolution prior to a given production operation, a lever 177 attached to an end of shaft 162 is simply turned from its full line position as viewed in FIG. 8 in a clockwise direction to its illustrated broken line position to axially shift sleeve 88 downwardly responsive to the following movements of shaft 162, yoke 164 and fork 176 to engage four lobe cam 92 with cam follower roll 44. Such axial shifting of sleeve 88 is readily achieved since the sleeve gear teeth 90 simply slide within the tooth spaces of their meshing output spider gears 80 which are shown to be of a greater length than the gear teeth 90 integrally formed on sleeve 88. The mode select shaft 162 and fork 176 are releasably retained in a selected position by a spring biased detent 178 mounted on lever 176 to be removably received within one of two openings such as at 180. The openings are provided in a selector block 182 on frame 22 on opposite sides of a position sensing post 184 fixed to block 182, for selectively establishing the desired drive setting of the starter drive mechanism 36.

Since the starter cams 92, 94 are permanently assembled to the differential output gear 90 in the machine 10 and the described gearing readily permits the described axial shifting movement of the differential output gear 90 relative to the intermediate gearing 78, 80, it will be seen that the number of given die starts may be easily changed between three and four by merely shifting the mode select lever 177. Moreover, each of the operating components other than the lever 177 are housed in a desirable environment in a well lubricated gear case.

In FIG. 6 a second embodiment of a selectively settable cam drive connection to the starter drive mechanism 36 is illustrated. This second embodiment provides for alternatively establishing a drive setting to the starter drive mechanism 36, e.g., for providing either three or four workpiece starts per revolution of spindle 20 and its circular die 18. As in the first described embodiment, an interlock 160 is provided which comprises the previously described components including the manual mode select shaft 162 which is connected to the cam drive connection. It is to be understood that the mode select shaft 162 is suitably supported on frame 22 for oscillatory movement as described in the first embodiment about the axis of shaft 162. Upon manually turning the shaft by lever 177 in opposite angular directions between first and second operating positions illustrated in FIG. 8 for the lever 177, a selected one of the first and second drive settings is established. With the mode select lever 177 in one of its operating positions, the shaft 162 is drivingly connected by way of its arm such as illustrated at 170 in FIG. 6 to a cross pin 190 secured to the upright shaft 146 of the combined gear and cam stack 144 to engage its gear 142 in mesh with change gear 138 of the differential output compound gears. The combination gear and cam stack 144 thus will be seen to be connected to the interlock 160 and axially shiftable by clockwise rotation of arm 170 as viewed in FIG. 6 by rotating its mode select shaft 162 to alternatively establish a second drive setting of the cam drive connection wherein gear 140 of the combination gear and cam stack 144 is in mesh with change gear 136 of the differential output compound gear. The combination gear and cam stack 144 accordingly provides the gears 140 and 142 engageable alternatively with different gears 136 and 138 respectively for driving the single lobe starter cam 152 at different velocity ratios. For example, when gears 142 and 138 are in mesh as in FIG. 6, a 3:1 drive output is established. When the interlock 160 is operated to axially shift the combination gear and cam stack 144 downwardly, gears 140 and 136 are engaged to establish a 4:1 drive output to the single lobe starter cam 152, thereby changing the drive select mode from three die starts per spindle revolution to four die starts per revolution.

As will be apparent to persons skilled in the art, various modifications, adaptations and variations of the foregoing specific disclosure can be made without departing from the teachings of this invention.

I claim:

1. For use in a workpiece forming machine having a spindle rotatably mounted on a fixed frame with a circular die secured to the spindle for rotation therewith and a movable starter for successively feeding workpieces to the circular die at a forming station, a variable starter timing control comprising a differential having a first rotary input drive movable in response to the spindle, a second rotary input drive selectively operable to impart a supplementary input to the differential, and an output drive connected to the starter for operating it in selectively timed relation to rotation of the circular die in accordance with the combined inputs of the first and second input drives.

2. The timing control of claim 1 wherein the starter includes a cam controlled drive mechanism, wherein the first rotary input drive comprises a first gear mounted on the spindle for rotation with the spindle, wherein the output drive is provided on a sleeve supported for rotation on the spindle in coaxial relation to the spindle and the first input gear, the sleeve having gear teeth in mesh with the first input gear, and wherein a starter cam is fixed to the sleeve for imparting predetermined movements to the starter drive mechanism for controlling the operation of the starter in timed relation to spindle rotation.

3. The timing control of claim 1 wherein the starter includes a cam controlled drive mechanism, wherein the differential further includes a supporting shaft journaled on the frame in offset parallel relation to the spindle for supporting components of the differential, and wherein a starter cam is connected to the differential output drive for imparting predetermined movements to the starter drive mechanism for controlling the operation of the starter in timed relation to spindle rotation.

4. The timing control of claim 1 wherein a manual drive operator is drivingly connected to the second rotary input drive of the differential for imparting angular movement to its output drive independently of the first rotary input drive under stationary or dynamic conditions.

5. The timing control of claim 1 wherein the starter includes a drive mechanism having a cam follower, and the differential output drive includes a cam in driving engagement with the cam follower for operating the starter in timed relation to rotation of the circular die.

6. The timing control of claim 1 wherein the differential includes a gear carrier coaxially supported on the spindle with intermediate gearing supported on the gear carrier and drivingly connecting the first rotary input drive and output drive.

7. The timing control of claim 6 wherein the second rotary input drive is drivingly connected to the gear carrier for selectively rotating the gear carrier and the intermediate gearing carried thereby to effect said supplementary input to the differential.

8. The timing control of claim 6 wherein the intermediate gearing includes gear means mounted for rotation about its rotational axis and rotatably supported on the gear carrier in mesh with the first rotary input drive and the output drive.

9. The timing control of claim 8 further including a worm gear circumferentially extending about the gear carrier, and a worm journaled on the frame in mesh with the carrier worm gear, the worm being mounted on a manually rotatable operator shaft for imparting said supplementary input to the differential for adjusting the timing of the starter in relation to rotation of the circular die.

10. The timing control of claim 1 wherein the starter includes a cam controlled starter drive mechanism, wherein starter cam means is rotatably supported on the frame to be driven by the output drive, the starter cam means being axially shiftable on the frame in continuous driving engagement with the output drive for selectively imparting different cam motions to be followed by the starter drive mechanism, and wherein a manual mode select drive is provided for axially shifting the starter cam means for selectively changing the number of starter operations for each revolution of the spindle and its circular die.

11. An assembly usable in a workpiece forming machine for adjusting the operational timing under both stationary and dynamic conditions of a movable starter for successively feeding workpieces to a forming station and comprising a fixed frame, a spindle rotatably mounted on the frame, workpiece forming dies at the forming station including a circular die secured to the spindle for rotation therewith, an adjustable drive mechanism for operating the starter in timed relation to rotation of the circular die, a rotary input driven by the spindle, a driven rotary output for driving the starter drive mechanism, intermediate idler gear means drivingly connecting the rotary input and rotary output, and a second rotary input manually operable for selectively changing the relative angular positions of the first rotary input and the rotary output for adjusting the operational timing of the starter in relation to the circular die.

12. For use in a workpiece forming machine having a spindle rotatably mounted on a fixed frame with a circular die secured to the spindle for rotation therewith and a starter for successively feeding workpieces to the circular die at a forming station responsive to a cam controlled starter drive mechanism, a starter drive selector comprising a spindle operated, selectively settable cam drive connection to the starter drive mechanism for driving it in a first drive setting and alternatively in a second drive setting different from that established in the first setting, and an interlock connected to the cam drive connection and movable between first and second operating positions to effectively change the drive setting from one to the other of said first and second drive settings.

13. The drive selector of claim 12 wherein the cam drive connection comprises a rotary output driven by the spindle, starter disk cam means driven by the rotary output, the starter disk cam means being axially shiftable by the interlock for selectively establishing different drive connections between the spindle and the starter drive mechanism in said first and second drive settings to impart different driving cam motions to be followed by the cam controlled starter drive mechanism such that a predetermined number of starter operations are effected for each revolution of the spindle and its circular die.

14. The drive selector of claim 12 wherein the interlock comprises a manual mode select shaft connected to the cam drive connection and supported on the frame for oscillatory movement about its axis in opposite angular directions between said first and second operating positions for establishing a selected one of said first and second drive settings.

15. The drive selector of claim 14 wherein the cam drive connection comprises a spindle operated rotary output sleeve coaxially supported for rotation on the spindle and axially shiftable thereon, a pair of starter disk cams having different working profiles mounted on the sleeve for rotation therewith, the cams being alternatively engageable with the starter drive mechanism.

16. The drive selector of claim 15 wherein the interlock further includes a yoke connected between the mode select shaft and the sleeve for axially shifting the sleeve and its cams responsive to movement of the mode select shaft between its operating positions to engage a selected one of the cams with the cam connected starter drive mechanism to establish a desired drive setting.

17. The drive selector of claim 16 wherein the interlock further includes an arcuate shifter fork disposed between the starter disk cams on the sleeve, the shifter fork being pivotally mounted on the yoke for axially shifting the sleeve and its starter cams to a selected position establishing a desired drive setting corresponding to a selected operating position of the mode select shaft.

18. The drive selector of claim 14 wherein the cam drive connection comprises a gear train driven by the spindle and including compound change gears, and a combination gear and cam stack rotatable on the frame about an axis in spaced parallel relation to the rotational axis of the compound change gears, the combination gear and cam stack including a pair of gears engageable alternatively with different gears of the compound change gears for driving the cam at different velocity ratios.

19. The drive selector of claim 18 wherein the combination gear and cam stack is connected to the interlock and axially shiftable thereby for selectively establishing said first and second drive settings of the cam drive connection responsive to the interlock being moved into said first and second operating positions.

20. The drive selector of claim 12 further comprising a variable starter timing control including a differential having a first rotary input drive movable in response to the spindle, a second rotary input drive selectively operable to impart a supplementary input to the differential, and an output drive connected to the cam drive connection to the starter drive mechanism for operating the starter in selectively timed relation to rotation of the circular die in accordance with the combined inputs of the first and second input drives.

* * * * *

UNITED STATES PATENT AND TRADEMARK OFFICE

CERTIFICATE OF CORRECTION

PATENT NO. : 4,088,045

DATED : May 9, 1978

INVENTOR(S) : Edward Gregory Grohoski

It is certified that error appears in the above-identified patent and that said Letters Patent are hereby corrected as shown below:

Column 4, line 53, "10" should be --110--;

Column 5, line 8, before "rotatable" insert --a--;

Column 8, line 62, "drive" should be --device--; and

Column 10, lines 13-14, "connected" should be --controlled--.

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*